US008402957B1

(12) United States Patent
Clark

(10) Patent No.: US 8,402,957 B1
(45) Date of Patent: Mar. 26, 2013

(54) RELEASE DEVICE FOR ARCHERY

(76) Inventor: Rick W. Clark, Tucson, AZ (US)

( * ) Notice: Subject to any disclaimer, the term of this patent is extended or adjusted under 35 U.S.C. 154(b) by 308 days.

(21) Appl. No.: 12/870,717

(22) Filed: Aug. 27, 2010

Related U.S. Application Data

(60) Provisional application No. 61/237,976, filed on Aug. 28, 2009.

(51) Int. Cl.
*F41B 5/18* (2006.01)

(52) U.S. Cl. ..... 124/35.2

(58) Field of Classification Search ..... 124/35.1, 124/35.2
See application file for complete search history.

(56) References Cited

U.S. PATENT DOCUMENTS 4,316,443 A * 2/1982 Giacomo ..... 124/35.2
5,027,786 A * 7/1991 Peck ..... 124/35.2
5,845,628 A * 12/1998 Pellerite ..... 124/35.2
7,328,694 B2 2/2008 Edmonds

* cited by examiner

*Primary Examiner* — Gene Kim
*Assistant Examiner* — Amir Klayman

(57) ABSTRACT

A release device for archery. The release device features a string holding component having a first end for temporarily engaging a string; and a trigger component disposed in front of the string holding component, the trigger is positioned so as to be parallel with a string when said string is engaged in the first end of the string holding component. Pressing of the trigger causes the first end of the string holding component to release a string.

4 Claims, 9 Drawing Sheets

RELEASE DEVICE FOR ARCHERY

CROSS REFERENCE

This application claims priority to U.S. provisional application Ser. No. 61/237,976 filed Aug. 28, 2009, the specification of which is incorporated herein by reference in its entirety.

FIELD OF THE INVENTION

The present invention is directed to a release device used in archery, more particularly to a device wherein the string-gripping component is behind the trigger component. The device of the present invention allows for the archer's draw length to be adjusted (e.g., to suit the user's custom fit). The device gives the user the ability to adjust draw length while keeping the same anchor point.

BACKGROUND OF THE INVENTION

Release devices used in archery generally involve a mechanism wherein a string holding component (e.g., clip component) temporarily grasps the string and a trigger is pulled to release the string from the clip component. The trigger is situated behind the clip component (e.g., the clip component is closer to the bow than the trigger is). With this configuration, the draw length of an archer (or bowman) may be variably decreased as compared to the draw length if the archer were to use his/her fingers. The present invention features release devices wherein the trigger is situated in front of the string holding component (e.g., to simulate shooting with finger with the accuracy of a mechanical release). This configuration can eliminate the draw length reduction that occurs when using a device with a trigger behind the clip. The device of the present invention can also provide the archer additional draw length. This may be advantageous because it may help improve performance (e.g., increased speed, increased flight distance, increased accuracy), and it may also allow an archer to use a variety of draw lengths, for example a bow that may normally have too long of a draw for the archer. The present invention also features methods of releasing strings on an archery bow.

SUMMARY

The present invention features archery release devices. In some embodiments, the devices comprise a housing having a front end, a back end, and an inner cavity; a string holding component pivotally attached in the inner cavity of the housing via a first pivot component, the string holding component is positioned at the top end of the housing, the string holding component has a first end that extends out of the inner cavity of the housing above the top end of the housing and a second end positioned in the inner cavity of the housing, the first end is adapted to temporarily engage a string of a bow, the string holding component can pivot about the first pivot component between at least an engaged position wherein the first end can hold a string with tension without the string holding component pivoting about the first pivot component and a disengaged position wherein the string holding component is able to pivot about the first pivot component; a trigger slidably disposed in the front end of the housing in front of the string holding component, the trigger is positioned so as to be in-line (i.e., parallel) with a string when said string is engaged in the first end of the string holding component, the trigger comprises a shaft portion having a first end and a second end and a head portion disposed on the first end of the shaft, the head portion extends out of the front end of the housing and the second end of the shaft extends into the inner cavity of the housing, the trigger can move between at least a pressed position and a released position; a sear having a first end and a second end disposed in the inner cavity of the housing, the first end contacts the shaft of the trigger and the second end is pivotally attached in the inner cavity of the housing via a second pivot component, the sear can pivot between at least a locked position wherein the first end of the sear is pivoted toward the front end of the housing and a released position wherein the first end of the sear is pivoted away from the front end of the housing, wherein a sear groove is disposed in a top surface of the sear adapted to engage the second end of the string holding component when the sear is in the locked position securing the string holding component in the engaged position; and a sear spring disposed behind the sear contacting a back surface of the sear and pushing the sear forwardly, the sear spring biases the sear in the locked position, the sear spring biases the trigger in the released position due to the spring providing upward pressure on the sear.

When the trigger is moved to the pressed position the shaft of the trigger puts downward pressure on the first end of the sear, compressing the sear spring and pivoting the sear from the locked position to the released position. When the sear is in the released position the second end of the string holding component becomes disengaged from the sear groove and the string holding component pivots to the disengaged position allowing a string engaged in the first end of the string holding component to be released.

In some embodiments, a first groove is disposed in the front end of the housing and a second groove is disposed in the back end of the housing opposite the first groove, the grooves function to provide comfort to a user when holding the release device. In some embodiments, the release devices further comprise a screw component disposed in a threaded shaft in the sear extending from the back surface of the sear to a front surface of the sear. In some embodiments, a back end of the screw component engages the sear spring and a front end of the screw component engages the second end of the string holding component.

In some embodiments, the release devices comprise a string holding component having a first end for temporarily engaging a string; and a trigger component disposed in front of the string holding component, the trigger is positioned so as to be in-line (i.e., parallel) with a string when said string is engaged in the first end of the string holding component; wherein pressing of the trigger causes the first end of the string holding component to release a string.

In some embodiments, pressing of the trigger causes pivoting of the string holding component such that the first end of the string holding component releases a string. In some embodiments, the release devices further comprise a sear extending from the trigger to the string holding component, wherein pressing of the trigger causes pivoting of the sear from a locked position to a released position which causes pivoting of the string holding component such that the first end of the string holding component releases a string. In some embodiments, the sear is biased in the locked position caused by a sear spring. In some embodiments, the release devices further comprise a wristband for wrapping around a wrist; and a cord having a first end and a second end, the first end being attached to the wristband and the second end being attached to the release device.

The present invention also features a system comprising a release device comprising a string holding component having a first end for temporarily engaging a string; and a trigger component disposed in front of the string holding component, the trigger is positioned so as to be in-line (i.e., parallel with a string when said string is engaged in the first end of the string holding component; wherein pressing of the trigger causes the first end of the string holding component to release a string; a wristband for wrapping around a wrist; and a cord having a first end and a second end, the first end being attached to the wristband and the second end being attached to the release device.

In some embodiments, pressing of the trigger causes pivoting of the string holding component such that the first end of the string holding component releases a string. In some embodiments, release device further comprises a sear extending from the trigger to the string holding component, wherein pressing of the trigger causes pivoting of the sear from a locked position to a released position which causes pivoting of the string holding component such that the first end of the string holding component releases a string. In some embodiments, the sear is biased in the locked position caused by a sear spring.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 7A shows a longer cord length and shorter draw length. FIG. 7B shows a shorter cord length and a longer draw length.

DESCRIPTION OF PREFERRED EMBODIMENTS

Figure 4:
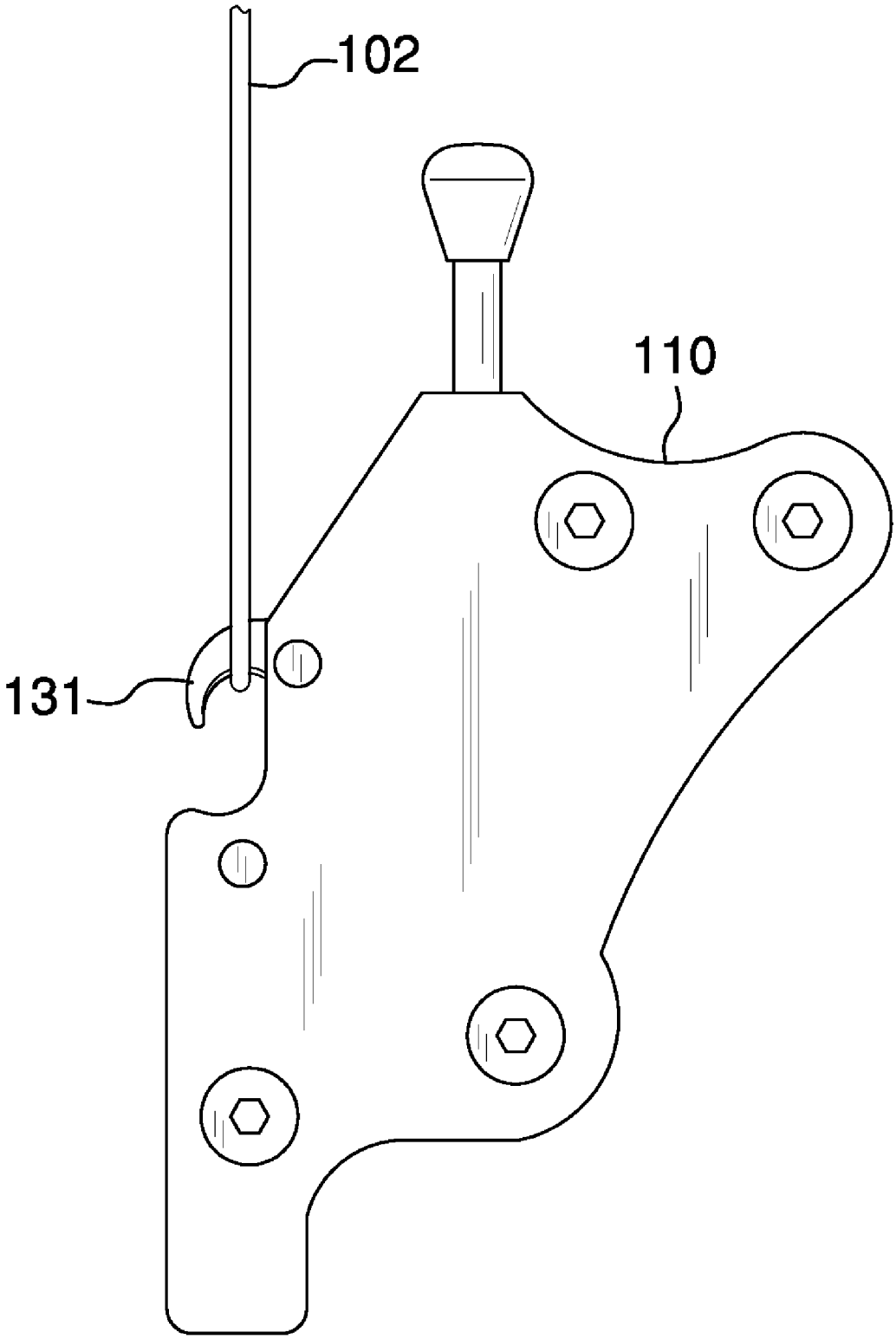
FIG. 4 is a side view of a release device of the present invention, wherein the string holding component is in the engaged position and is holding a string.
Figure 5:
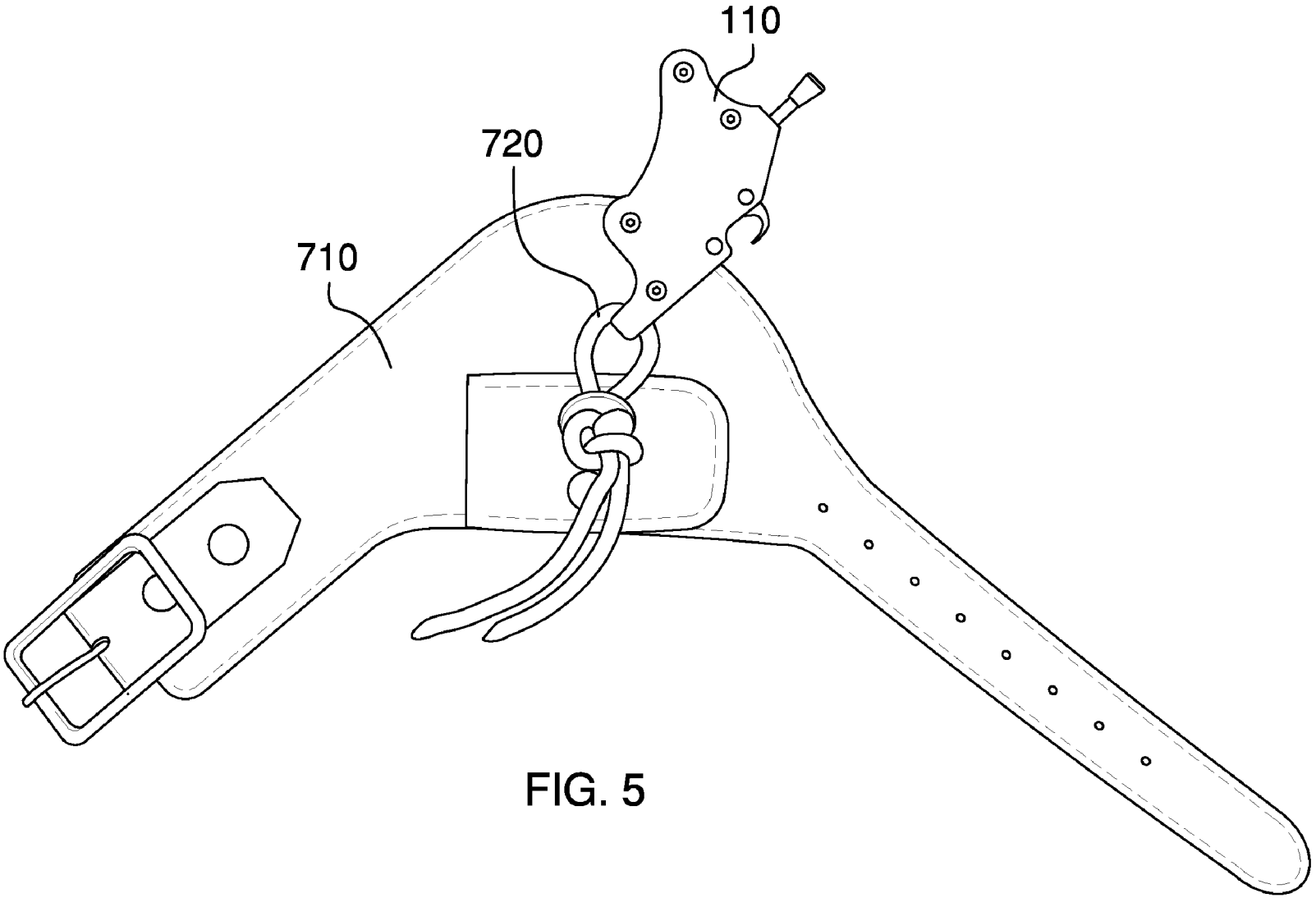
FIG. 5 is a top view of a release device of the present invention as attached to a wristband.
Figure 6:
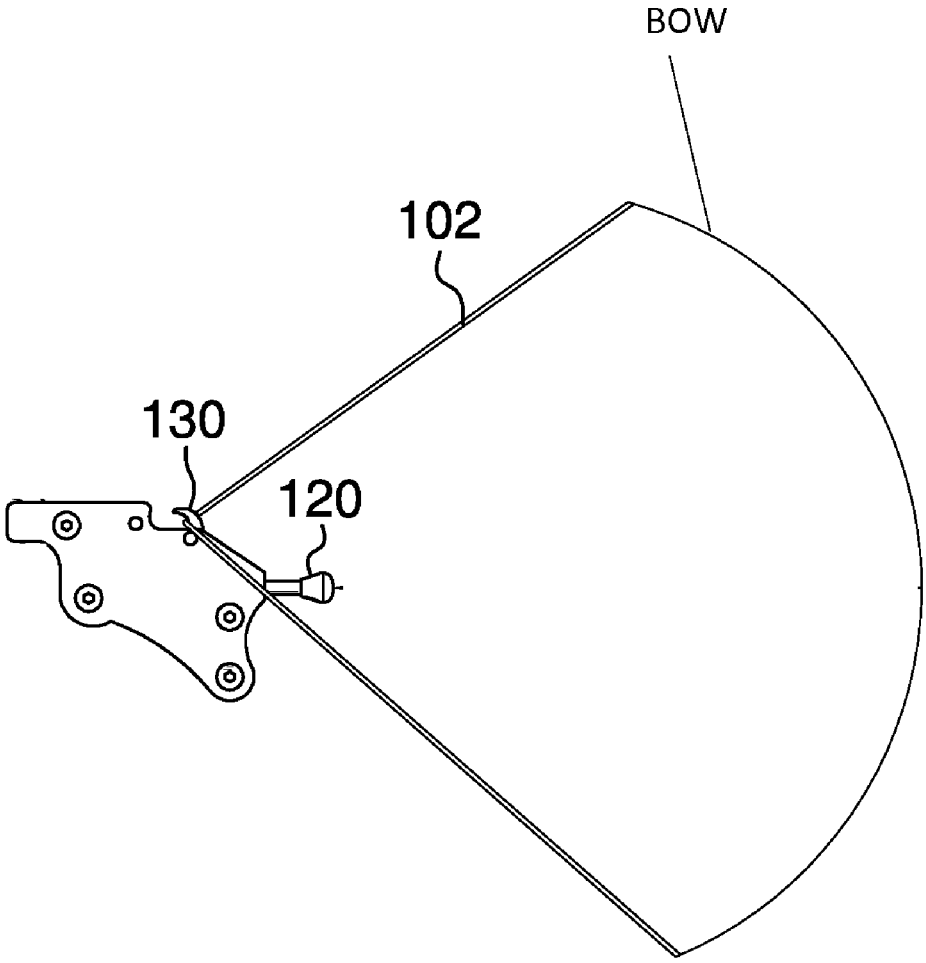
FIG. 6 is a schematic representation of the release device of the present invention as used with a bow, wherein the trigger (in-line plunger) of the device is in front of the string holding component (e.g., and the hook is closer to the shooter creating a more true draw length).

Referring now to FIGS. 1-8, the present invention features an archery release device 100 for releasing a string of a bow, wherein the trigger component is in front of the string holding component (e.g., and the hook is closer to the shooter creating a more true draw length) (see FIG. 6 for basic diagram). The present invention also features methods of releasing strings of bows. Release devices 100 of the present invention (e.g., having the hook closer a natural archer's release point, e.g., having the trigger component positioned in front of the string holding component) may be constructed using a variety of different mechanical mechanisms to release the string. The mechanisms described herein are examples and are not to limiting the present invention to any particular mechanism. As used herein, the release devices 100 are described for right-handed individuals. A device for a left-handed individual is constructed as a mirror image of the right-handed devices. Such left-handed devices can easily be conceived and constructed by one of ordinary skill in the art based on the disclosures herein.

Without wishing to limit the present invention to any theory or mechanism, it is believed that the release devices 100 of the present invention are advantageous because they allow for an archer's draw length to be adjusted. For example, the release devices 100 can add length (e.g., 1 inch, 2 inches, 3 inches) to the archer's draw length. In some embodiments, the release device 100 adds 2 inches to an archer's draw length, for example the archer has a natural draw length of 26 inches and with the device 100 of the present invention he has a new draw length of 28 inches. In some embodiments, the release device 100 adds 3 inches to an archer's draw length, for example the archer has a natural draw length of 27 inches and with the device 100 of the present invention he has a new draw length of 30 inches. This may be compared to traditional mechanical release devices, for example a user may have a natural draw length of 27 inches (e.g., with finger) and a traditional mechanical draw length of 24.25 inches due to a traditional mechanical release device.

The release device 100 of the present invention comprises a housing 110. The housing 110 may be constructed in a variety of shapes (and from a variety of materials), but generally the housing has a front end 113, a back end 114, a first side, a second side, a top end 115, and a bottom end. The terms "front end," "back end," "first side," second side," "top end," and "bottom end" are used for description purposes only and do not limit the present invention to any particular orientation. For example, when the device is in use, the "top end" may actually be positioned sideways and the "first side" or "second side" may actually be positioned on top or on bottom. Also, the sides may be reversed for a left-handed individual, for example.

Figure 1:
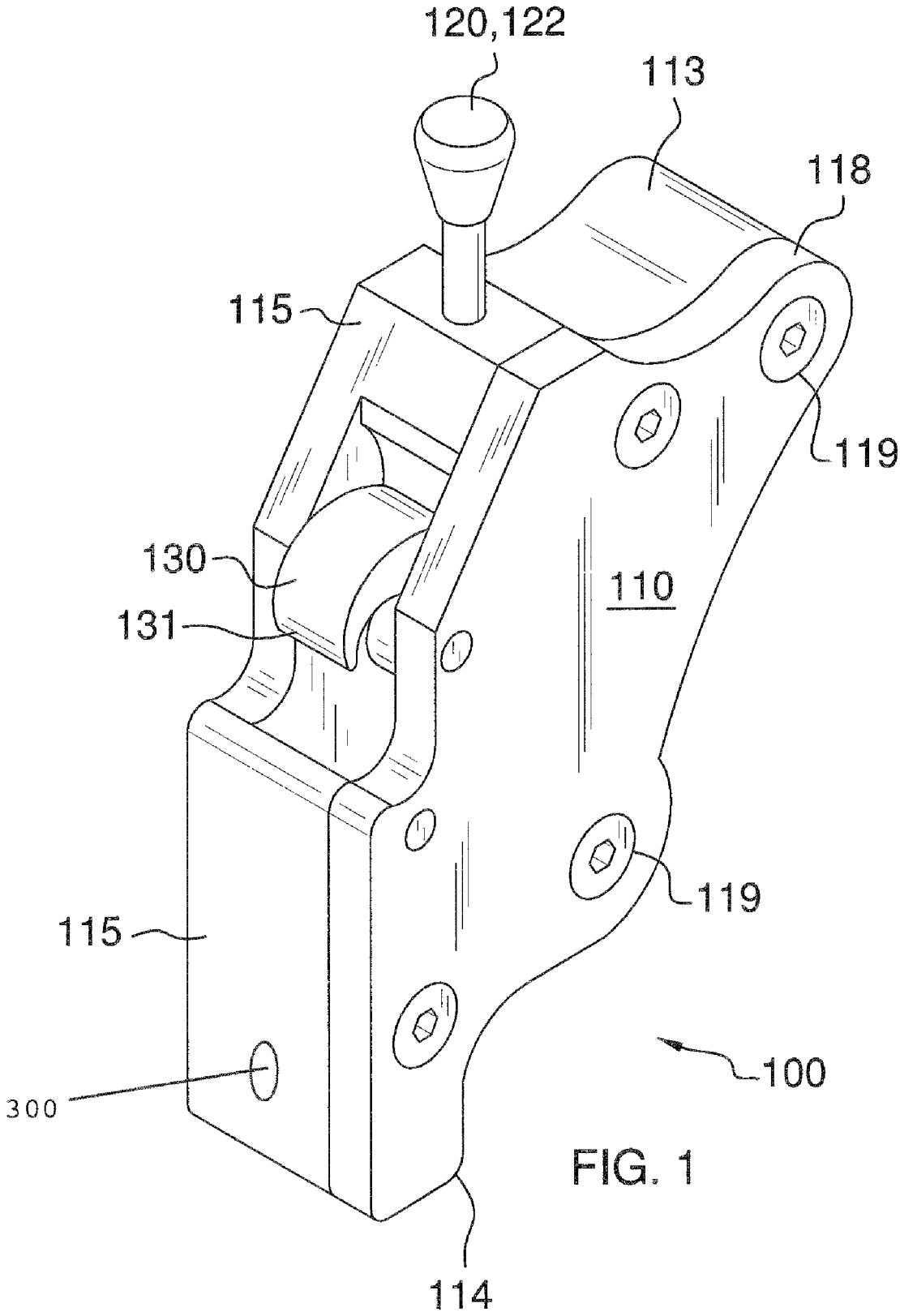
FIG. 1 is a perspective view of a release device of the present invention.
Figure 2:
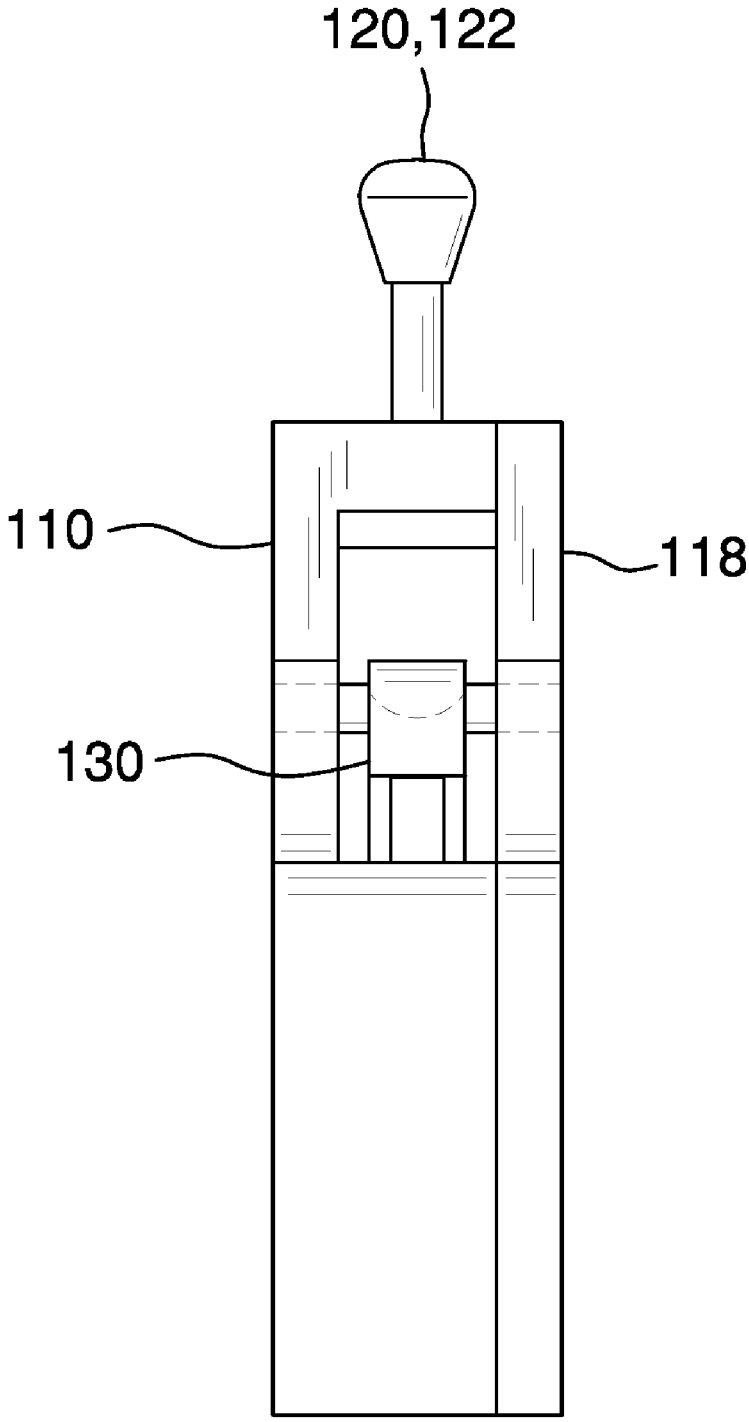
FIG. 2 is a top view of the release device of FIG. 1.
Figure 3A:
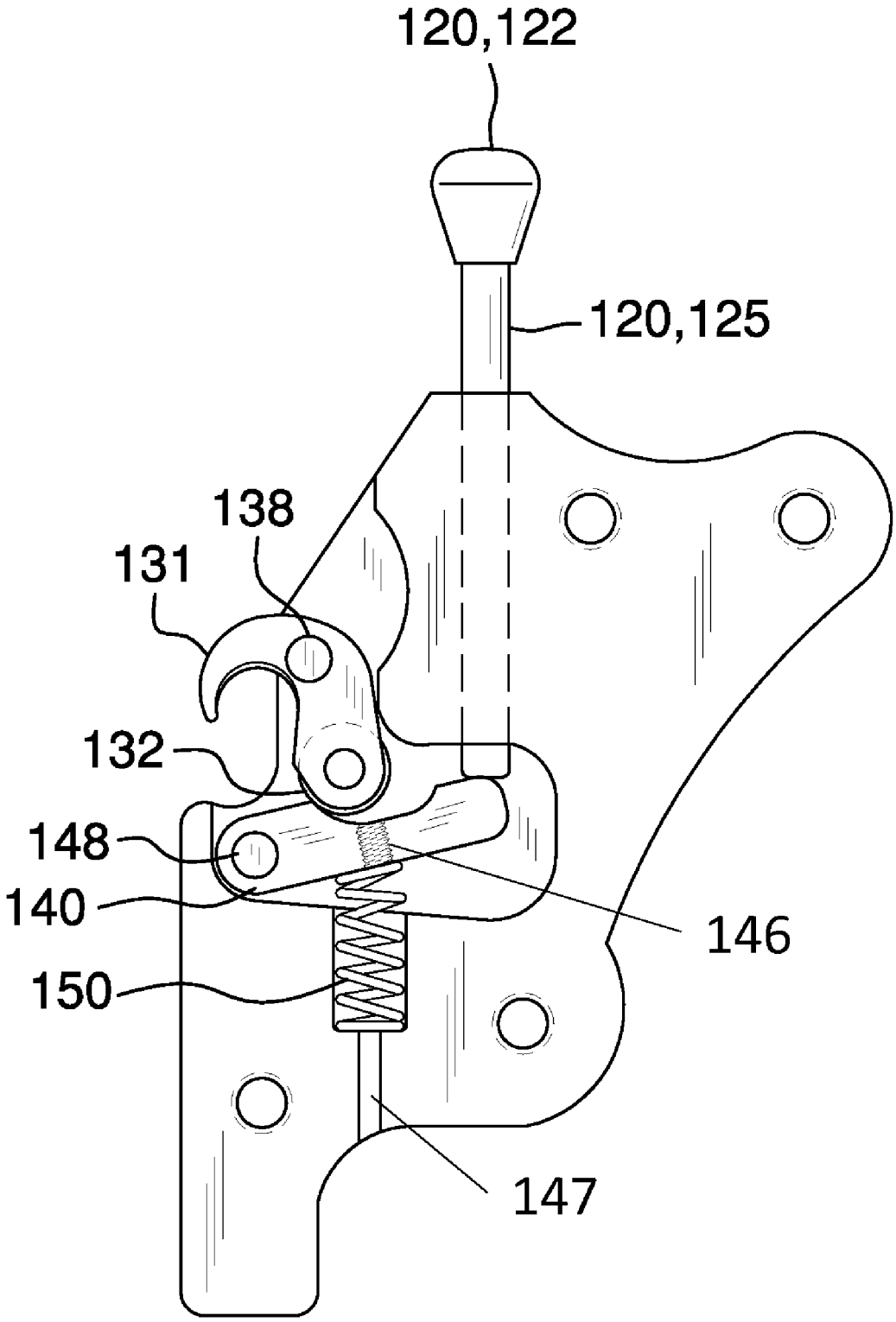
FIG. 3A is a side cross sectional view of a release device of the present invention, wherein the trigger is in the released position (e.g., relaxed position), the sear is in the locked position, and the string holding component is in the engaged position.
Figure 3B:
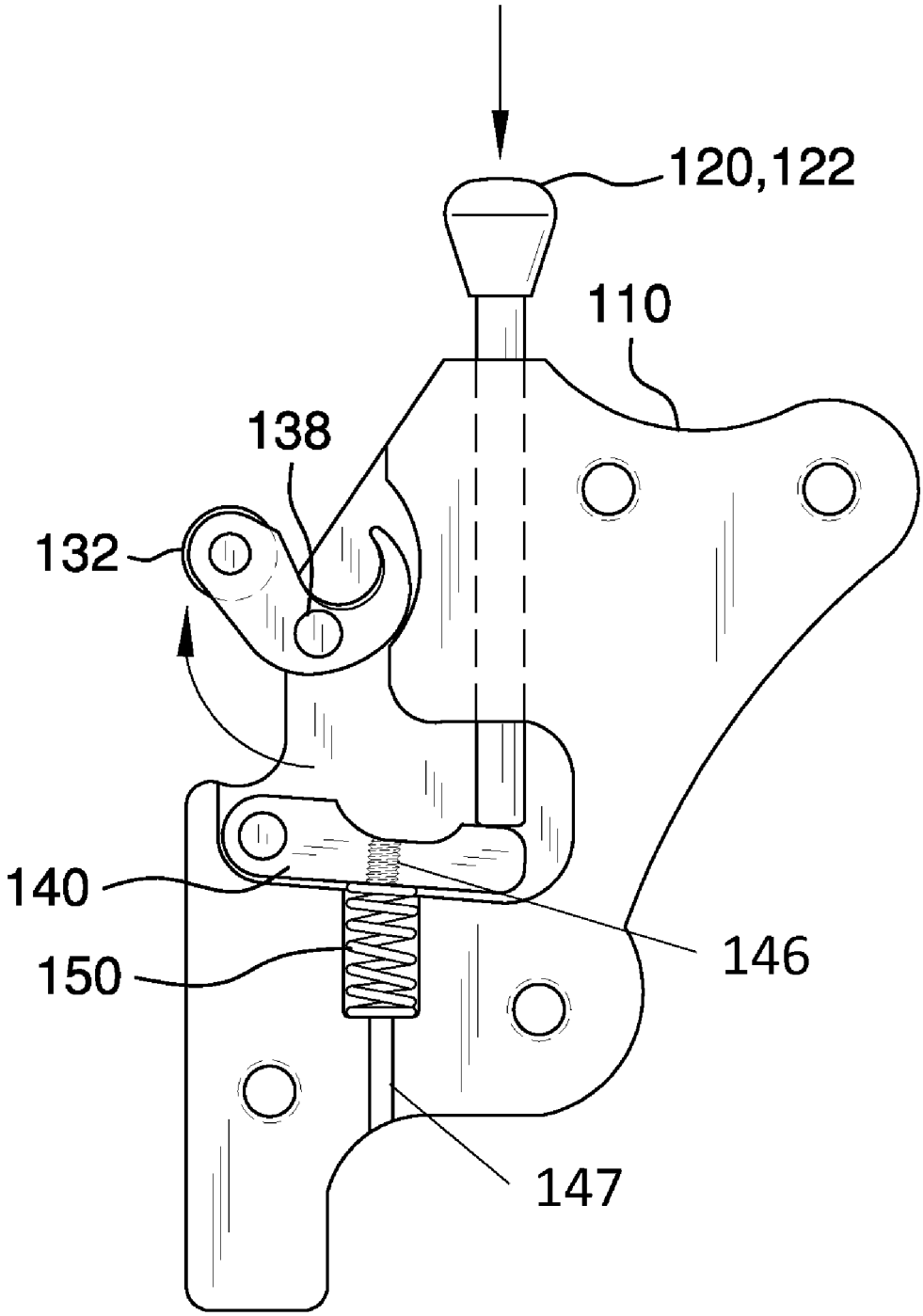
FIG. 3B is a side cross sectional view of a release device of the present invention, wherein the trigger is in the pressed position, the sear is in the released position, and the string holding component is in the disengaged position.

The housing 110 may be generally elongated. As shown in FIG. 1, the housing 110 comprises a variety of curves or grooves, providing optimal finger and hand position as well as providing comfort to a user. For example, a first groove is disposed in the front end 113 of the housing 110, and a second groove is disposed in the back end 114 of the housing 110 opposite the first groove 113. The bottom end of the housing 110 may be generally slanted or angled. The housing 110 is not limited to the aforementioned configurations.

The device 100 of the present invention further comprises both a string holding component 130 (e.g., a hook component, a nut) for temporarily holding the string and a trigger 120 (e.g., plunger), which causes the string to become free from the string holding component 130. The trigger 120 is positioned in front of the string holding component 130. For example, the trigger 120 may be slidably disposed at or near the front end 113 of the housing 110 and the string holding component may by disposed at or near the back end 114 of the housing 110, or the string holding component may be positioned at the top end 115 of the housing 110 (and at or near the back end 114 of the housing 110, or near the front end 113 of the housing 110).

The string holding component 130 is disposed in an inner cavity in the housing 110. The trigger 120 extends from the front end 113 of the housing 110 to the inner cavity of the housing 110. For example, the trigger comprises a shaft portion 125 and a head portion 122. The shaft portion 125 traverses a portion of the housing 110, for example the first end of the shaft 125 extends out of the housing 110 (e.g., out of the front end 113 of the housing 110) and the second end of the shaft 125 extends to the inner cavity of the housing 110. The head 122 is disposed on the first end of the shaft 125. When the head 122 is pressed, the shaft 125 is also pressed and moved further into the inner cavity of the housing 110.

The string holding component 130 (e.g., a hook component, a nut) is pivotally attached in the inner cavity of the housing 110 via a first pivot component 138 (e.g., the first pivot component 138 generally extends from the first side of the housing to the second side of the housing 110). The string holding component 130 (e.g., a hook component, a nut) has a first end 131 that extends out of the housing 110 (e.g., above the top end 115), wherein the first end 131 may comprise a hook (or alternative means of temporarily gripping the string). The string can rest in the first end 131 (e.g., hook) of the string holding component 130 (e.g., a hook component, a nut). The string holding component 130 has a second end 132 (e.g., comprising a roller) that is positioned in the inner cavity of the housing 110. The second end 132 may be generally rounded.

The string holding component 130 can pivot/rotate about the first pivot component 138. The string holding component 130 can pivot/rotate between multiple positions including but not limited to an engaged position and a disengaged position. In some embodiments, the engaged position refers to the string holding component 130 being positioned such that the first end 131 can hold a string with tension without the string holding component 130 pivoting (e.g., about the first pivot component 138) to release the string from the first end 131. In some embodiments, the engaged position refers the first end 131 (e.g., hook) of the string holding component 130 facing toward the back end 114 of the housing and the second end 132 being positioned in the inner cavity of the housing 110 (see FIG. 3A). In some embodiments, the disengaged position refers to the string holding component 130 being able to pivot about the first pivot component 138. In some embodiments, the disengaged position refers to the first end 131 (e.g., hook) facing toward the front end 113 of the housing 113 and the second end 132 being flipped out of the inner cavity of the housing (see FIG. 3B). Generally, when the string holding component 130 is in the engaged position a string 102 can be held by the first end 131 (e.g., hook) (see FIG. 4) and when the string holding component 130 is in the disengaged position the string 102 is released from the first end 131 (e.g., hook). Generally, when the trigger 120 is squeezed, that movement is translated into the movement of the string holding component 130 from the engaged position to the disengaged position so as to release the string.

The trigger 120 (e.g., plunger) is positioned so as to be generally in-line (i.e., parallel with the string when the string is held by the string holding component 130) (or with the first end of the string component 130 (e.g., when the string component 130 is in the engaged position). For example, as shown in FIG. 4, the plane of the string is parallel (e.g., in line) with the plane of the trigger 120. This is in contrast to a trigger that may be positioned at an angle with respect to the string. If the trigger was positioned at an angle with respect to the string, the movement of the trigger may produce torque, which would offset the expected trajectory and movement of the string. This may cause a decrease in accuracy of the shot.

A sear 140 (e.g., inner bar) is disposed in the inner cavity of the housing 110. The sear 140 may be generally elongated having a first end and a second end. In some embodiments, a sear groove is disposed in the top surface of the sear 140, wherein the sear groove is adapted to engage the second end 132 of the string holding component 130 when the string holding component 130 is in the engaged position (see FIG. 3A). Generally, the first end of the sear 140 contacts the trigger 120 (e.g., the shaft 125 of the trigger 120). The second end of the sear 140 is pivotally attached in the inner cavity of the housing via a second pivot component 148. The sear 140 can pivot between a locked position wherein the first end of the sear 140 is pivoted forwardly toward the front end 113 of the housing 110 (see FIG. 3A) and a released position wherein the first end of the sear 140 is pivoted away from the front end 113 of the housing 110 (see FIG. 3B). The sear 140 is biased in the locked position caused by a sear spring 150. The sear spring 150 may be disposed behind the sear 140, for example contacting the back surface of the sear 140 and pushing the sear 140 forwardly. In the locked position, the sear groove engages the second end 132 of the string holding component 130 and secures the string holding component 130 in the engaged position (the string is not released). In the released position, the movement of the sear 140 causes the sear groove to pivot away from the second end 132 of the string holding component 130, allowing the string holding component 130 to pivot to the disengaged position to release the string from the first end 131 (e.g., hook). In some embodiments, the tension of the string can help move the string holding component 130 to the disengaged position when the sear 140 is not engaging the string holding component 130.

The second end of the shaft 125 of the trigger 120 extends into the inner cavity of the housing 110, e.g., to the first end of the sear 140. The trigger 120 can move between multiple positions including a pressed position and a released position. The trigger 120 is biased in the released position caused by the upward pressure of the first end of the sear 140 on the shaft 120 of the trigger (see FIG. 3A). When the shaft 120 is moved to the pressed position (e.g., the head 122 is pressed), downward pressure is put on the first end of the sear 140, compressing the sear spring 150 and pivoting the sear 140 from the locked position to the released position. With the sear 140 in the released position, the string holding component 130 pivots to the disengaged position, allowing the string 102 to be released from the first end 131 (e.g., hook) of the string holding component 130 (e.g., a polished release mechanism that releases the string in such a way that it does not interfere with the natural travel of the string).

In some embodiments, a screw component 146 is disposed in the sear 140 (e.g., in a threaded shaft), for example spanning from the back surface to the front surface of the sear 140. The back end of the screw component 146 may engage the sear spring 150, and the front end of the screw component 146 may engage the second end 132 of the string holding component 130. The screw component 146 can be moved forwardly and backwardly within the threaded shaft in the sear, allowing a user to position the screw component 146 according to his/her needs. In some embodiments, the screw component 146 may provide additional force moving the string holding component 130 from the engaged position to the disengaged position when the sear is moved to the released position. In some embodiments, the screw component 146 may allow for adjustment of trigger movement and/or sensitivity. In some embodiments, a housing channel 147 is disposed in the housing 110 below the sear spring 150 (e.g., see FIG. 3A, FIG. 3B). The housing channel 147 may allow for adjustment of the screw component 146 (e.g., provide access to the screw component 146).

In some embodiments, the housing 110 is constructed as a whole piece, or the housing 110 is divided into two halves. For example, the first half may comprise a cover plate 118 secured to the second half via cover screws 119 (or other mechanism). The separate pieces may allow a user access to the inner cavity of the housing 110 and the components of the device 100 of the present invention.

In some embodiments, size adjustment may be accomplished with a wristband 710 and cord 720. In some embodiments, the devices 100 of the present invention may be constructed in a variety of sizes. For example, in some embodiments, the housing 110 is between about 1 to 2 inches in length as measured from the front end 113 to the back end 114. In some embodiments, the housing 110 is between about 2 to 4 inches in length as measured from the front end 113 to the back end 114. In some embodiments, the housing 110 is between about 4 to 8 inches in length as measured from the front end 113 to the back end 114. In some embodiments, the housing 110 is between about 8 to 12 inches in length. In some embodiments, the housing 110 is more than about 12 inches in length.

As used herein, the term "about" refers to plus or minus 10% of the referenced number. For example, an embodiment wherein the housing 110 is about 4 inches in length includes a housing 110 that is between 3.6 and 4.4 inches in length.

Figure 7A:
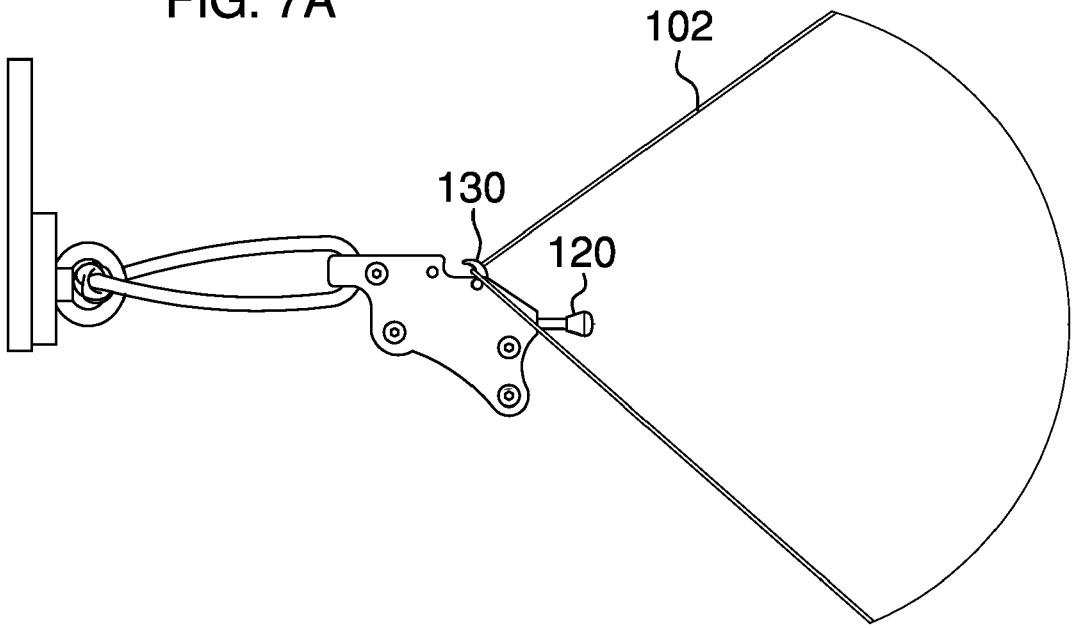
FIG. 7A and FIG. 7B are schematic representations of system of release devices with wristbands used to achieve different draw lengths. The first end of the cord is attached to the wristband and the second end is attached to the back end of the release device. In some embodiments, there is a through-hole 300 in the back end of the device for the cord to be inserted therethrough for attachment of the cord. The distance between the first end and the second of the cord is a cord length and is adjustable. A decrease in cord length provides for an increase in draw length and vice versa. In some embodiments, the system can increase draw lengths to about 3 inches.
Figure 7B:
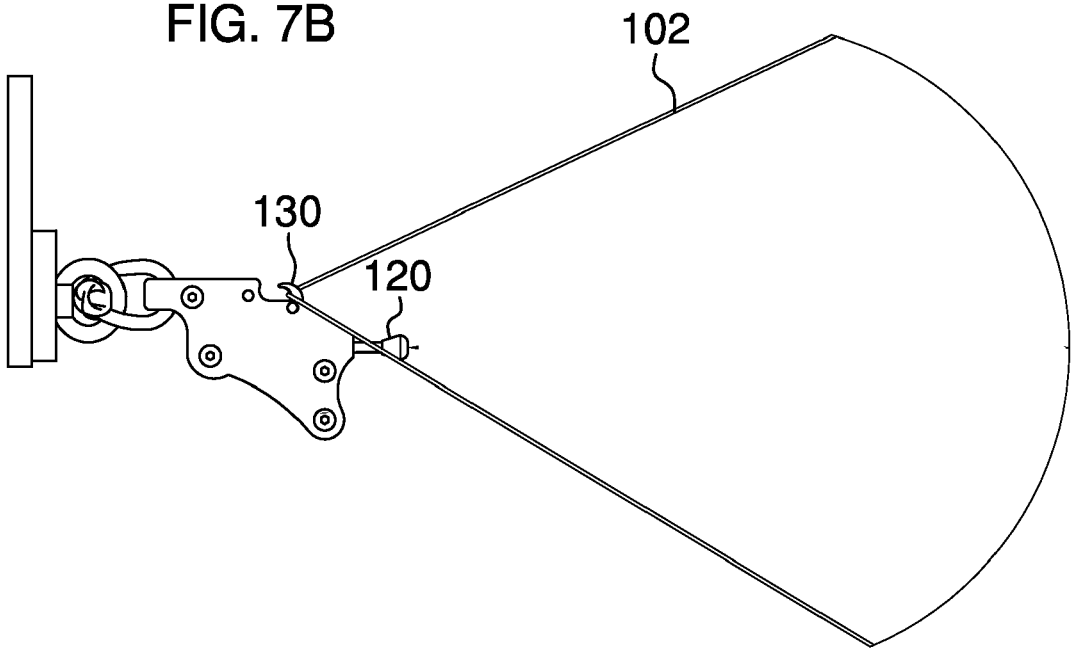

Without wishing to limit the present invention to any theory or mechanism, it is believed that the devices of the present invention (e.g., devices wherein the release point is closer to the shooter, e.g., wherein the trigger is in front of the string holding component) are advantageous because they can help eliminate draw length reduction that may occur when using a traditional release device with the string holding component further away from the shoter (e.g., with the trigger in back of the clip (string holding component). As shown in FIG. 7A and FIG. 7B, the devices of the present invention may also provide the user with adjustable draw length, which may help improve performance (e.g., increased speed, increased flight distance). The devices of the present invention may also add versatility to a user's bow. For example, a user can buy a bow that may have too long of a drawn length for him/her. The device of the present invention can help the user gain draw length (so the large sized bow can be used appropriately and effectively) while at the same time positioning the trigger at a position that is appropriate for the size of the user. These devices provide an archer an alternative to continually buying new and bigger bows as he/she grows (e.g., gets older), which may be quite expensive.

In some embodiments, the archer's draw length can be adjusted (e.g., lengthened) with the devices 100 of the present invention. As shown in FIG. 7A and FIG. 7B, in some embodiments, the draw length is further adjusted via a cord 720. For example, in some embodiments, the housing 110 is not directly attached to a wristband 710 and instead is attached to a wristband 710 via a cord component 720. The cord component may allow the housing 110 to be "free floating." Thus, if the cord component 720 is adjusted, the archer's draw length may be adjusted (e.g., the cord component may be shortened or lengthened). As shown in FIG. 5, the wristband 710 may have an outer end and a curved inner end, the curved inner end being for positioning in the palm of the user's hand and the outer end being for positioning around the user's wrist. The cord component 720 may be attached near or at the outer end of the wristband 710.

Without wishing to limit the present invention to any theory or mechanism, it is believed that the "free floating" conformation of the device 100 of the present invention is advantageous because no undue torque is directed to the release device 100 during firing.

Without wishing to limit the present invention to any theory or mechanism, it is believed that the devices (and wristbands, etc) of the present invention are advantageous because the trigger (e.g., plunger) is in line with the string, eliminating torque that may occur if the trigger was at an angle with respect to the string; the devices allow for adjustment (e.g., addition) of draw length (e.g., three inches), the devices allow for maintaining existing anchor points, the devices may help increase arrow speed, the devices may help increase kinetic energy, and the devices may be used as back tension.

EXAMPLE 1

Use of Release Devices for Oversized Bow

The present invention is not limited to adjusting draw length via a wristband and cord. For example, in some embodiments, the devices of the present invention can be constructed in various sizes. Different sized devices may help provide adjustment in draw length.

Figure 8A:
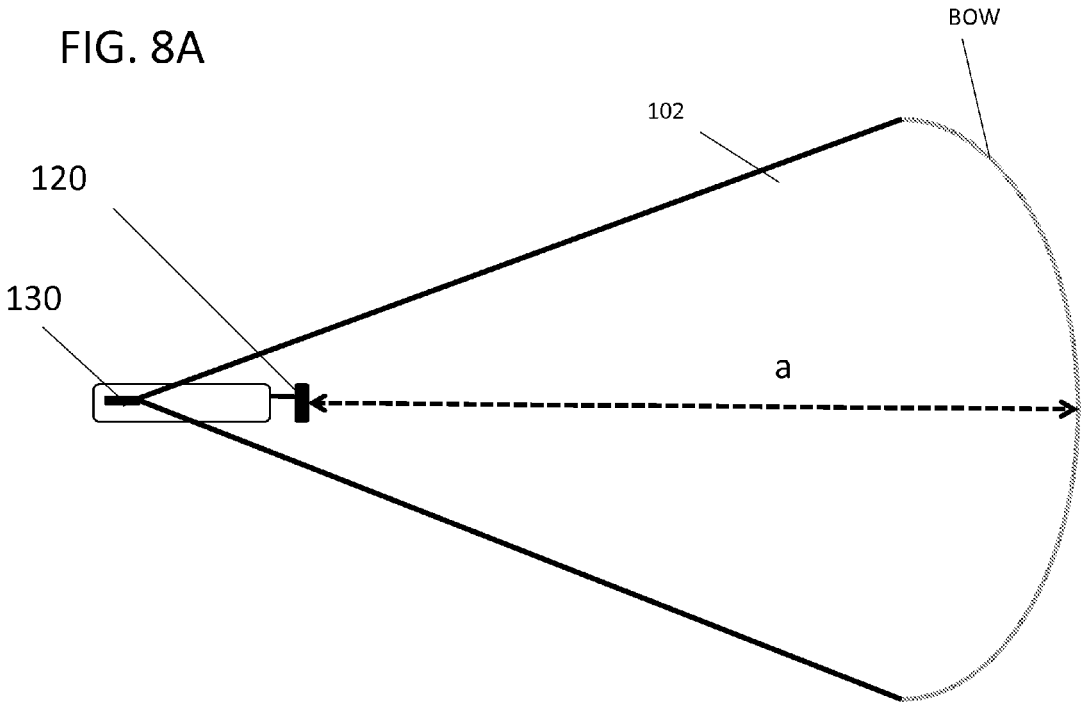
FIG. 8A and FIG. 8B are schematic representations of different sized release devices used to achieve different draw lengths.
Figure 8B:
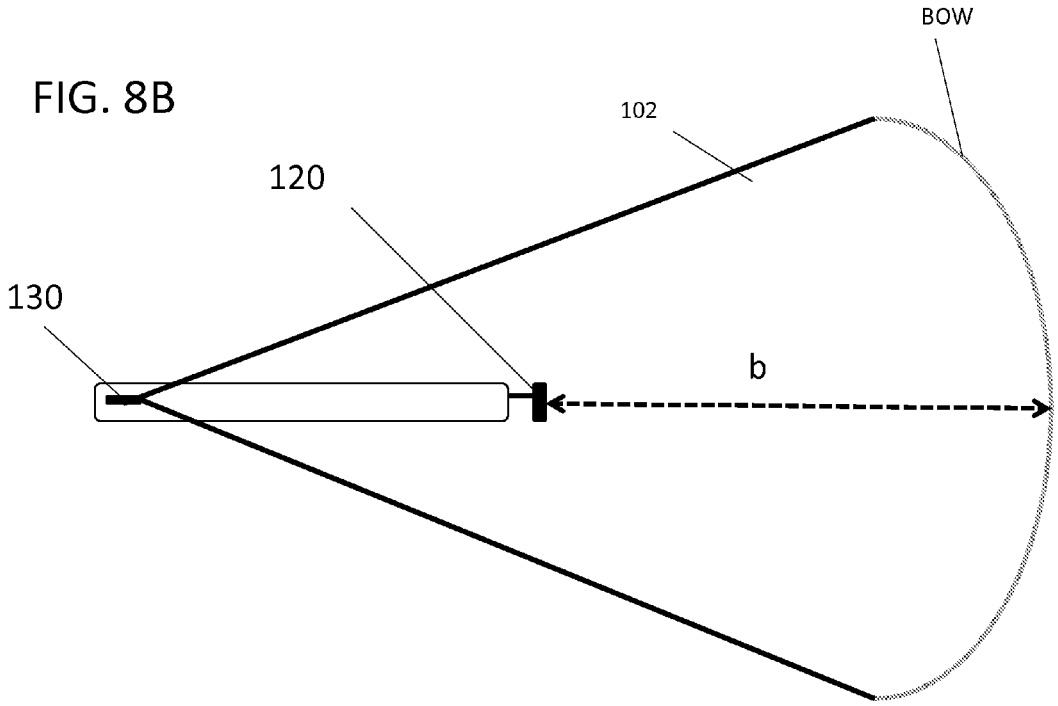

Referring now to FIG. 8, a 12-year-old girl obtains a bow that she plans to use for the following 10 years. The bow that she purchases is has too long of a draw length for her as it requires a large draw length "a" (see FIG. 8A) and she is not large enough to pull back the string that far. The girl also obtains a large-sized release device of the present invention having a long length. The large-sized release device compensates for her small draw length. As shown in FIG. 8B, the large-sized release device allows the girl to achieve the appropriate draw length (draw length "a") with her own smaller draw length (draw length "b") because the trigger is in a position that is consistent with her smaller draw length (draw length "b"), yet the string can be pulled back to the larger draw length (draw length "a") because the string holding component is much farther behind trigger. Throughout the next several years, the girl gets older and grows in size, which in turn increases her draw length. Because she can pull the string farther back on her own, she obtains a new release device that is smaller than her original large-sized release device. She may continue to obtain replacement release devices 100 (smaller release devices) as her own draw length increases until she achieves the appropriate draw length (draw length "a") on her own.

The disclosures of the following U.S. Patents are incorporated in their entirety by reference herein: U.S. Pat. No. 7,328, 694.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto.

What is claimed is:

1. An archery release device comprising:

(a) a housing having a front end, a back end, and an inner cavity;

(b) a string holding component pivotally attached in the inner cavity of the housing via a first pivot component, the string holding component is positioned at the top end of the housing, the string holding component has a hooked first end that extends out of the inner cavity of the housing above the top end of the housing and a rounded second end having a roller positioned in the inner cavity of the housing, the hooked first end is adapted to temporarily engage a string of a bow, the string holding component can pivot about the first pivot component between at least an engaged position wherein the hooked first end can hold a string with tension without the string holding component pivoting about the first pivot component and a disengaged position wherein the string holding component is able to pivot about the first pivot component;

(c) a trigger slidably disposed in the front end of the housing in front of the string holding component, the trigger is positioned so as to be parallel with a string when said string is engaged in the hooked first end of the string holding component, the trigger comprises a shaft portion having a first end and a second end and a head portion disposed on the first end of the shaft, the head portion extends out of the front end of the housing and the second end of the shaft extends into the inner cavity of the housing, the trigger can move between at least a pressed position and a released position;

(d) a sear having a first end and a second end disposed in the inner cavity of the housing, the first end contacts the shaft of the trigger and the second end is pivotally attached in the inner cavity of the housing via a second pivot component, the sear can pivot between at least a locked position wherein the first end of the sear is pivoted toward the front end of the housing and a released position wherein the first end of the sear is pivoted away from the front end of the housing, wherein a sear groove is disposed in a top surface of the sear adapted to engage the roller on the rounded second end of the string holding component when the sear is in the locked position securing the string holding component in the engaged position; and (e) a sear spring disposed behind the sear contacting a back surface of the sear and pushing the sear forwardly, the sear spring biases the sear in the locked position, the sear spring biases the trigger in the released position due to the spring providing upward pressure on the sear;

wherein when the trigger is moved to the pressed position the shaft of the trigger puts downward pressure on the first end of the sear, compressing the sear spring and pivoting the sear from the locked position to the released position, when the sear is in the released position the roller on the rounded second end of the string holding component becomes disengaged from the sear groove and the string holding component pivots to the disengaged position allowing a string engaged in the hooked first end of the string holding component to be released;

wherein the trigger component is anterior to the string holding component when the string holding component is engaged with the string of the bow, wherein the trigger component is closer to the bow than the string holding component when the string holding component is engaged with the string of the bow, wherein the hooked first end of the string holding component is closer to the shooter creating a more true draw length when the string holding component is engaged with the string of the bow.

2. The release device of claim 1, wherein a first groove is disposed in the front end of the housing and a second groove is disposed in the back end of the housing opposite the first groove, the grooves function to provide comfort to a user when holding the release device.

3. The release device of claim 1 further comprising a screw component disposed in a threaded shaft in the sear extending from the back surface of the sear to a front surface of the sear.

4. The release device of claim 3, wherein a back end of the screw component engages the sear spring and a front end of the screw component engages the roller on the rounded second end of the string holding component.

* * * * *